US009820588B2

(12) United States Patent
Sayegh et al.

(10) Patent No.: US 9,820,588 B2
(45) Date of Patent: Nov. 21, 2017

(54) RETAINER BASE FOR DISPLAY ARTICLE

(75) Inventors: Adel O. Sayegh, Rancho Cucamonga, CA (US); Ruben Rodriguez, Claremont, CA (US); Edgardo Redublo, Chino Hills, CA (US)

(73) Assignee: Universal Surveillance Corporation, Rancho Cucamonga, CA (US)

( * ) Notice: Subject to any disclaimer, the term of this patent is extended or adjusted under 35 U.S.C. 154(b) by 0 days.

(21) Appl. No.: 13/035,890

(22) Filed: Feb. 25, 2011

(65) Prior Publication Data

US 2011/0259790 A1 Oct. 27, 2011

Related U.S. Application Data

(60) Provisional application No. 61/308,878, filed on Feb. 26, 2010.

(51) Int. Cl.

| | |
|---|---|
| ***A47F 3/00*** | (2006.01) |
| ***B65D 81/02*** | (2006.01) |
| ***A47F 7/03*** | (2006.01) |
| ***E05B 73/00*** | (2006.01) |
| *A47F 7/024* | (2006.01) |

(52) U.S. Cl.

CPC ..... *A47F 7/03* (2013.01); *E05B 73/0023* (2013.01); *A47F 7/0246* (2013.01)

(58) Field of Classification Search

CPC ..... A47F 7/03; A47F 7/0246; E05B 73/0023
USPC ..... 206/775, 529, 756, 761, 817, 556; 248/346.01, 346.03, 346.04, 309.1, 316.1; 220/559; 108/55.1, 54.1; 74/89.17, 109, 74/569; 269/43, 246, 354 CS, 225

See application file for complete search history.

(56) References Cited

U.S. PATENT DOCUMENTS

| | | | | |
|---|---|---|---|---|
| 2,060,543 | A * | 11/1936 | White | 248/346.04 |
| 2,693,293 | A * | 11/1954 | Stuckart | 206/817 |
| 3,966,050 | A * | 6/1976 | Dahl | 211/10 |
| 5,297,485 | A * | 3/1994 | Bond | 108/55.1 |
| 5,398,898 | A * | 3/1995 | Bever | A47G 23/0225 248/154 |
| 5,788,202 | A * | 8/1998 | Richter | 248/316.4 |
| 6,029,940 | A * | 2/2000 | Klein | 248/346.04 |
| 6,454,107 | B1 * | 9/2002 | Belanger et al. | 206/556 |
| 6,789,773 | B2 * | 9/2004 | Holland | 248/307 |
| 6,811,131 | B2 * | 11/2004 | Kuo | 248/346.03 |
| 7,272,984 | B2 * | 9/2007 | Fan | 74/89.17 |
| 7,407,143 | B1 * | 8/2008 | Chen | 248/309.1 |
| 7,537,190 | B2 * | 5/2009 | Fan | 248/309.1 |
| 7,614,595 | B2 * | 11/2009 | Richter | 248/346.01 |
| 7,967,269 | B2 * | 6/2011 | Liu | 248/287.1 |
| 2007/0262223 | A1 * | 11/2007 | Wang et al. | 248/346.07 |
| 2010/0170825 | A1 * | 7/2010 | Luberto | 206/756 |

* cited by examiner

*Primary Examiner* — Andrew Perreault
(74) *Attorney, Agent, or Firm* — Milord A. Keshishian

(57) ABSTRACT

A device that enables a safe, secure display of an article within a merchandising or security display box, preventing a substantial lateral and vertical movement of the article within a merchandising or security display box for maintaining proper position and display orientation of the article inside the merchandising or security display box even if the merchandising or security display box is moved.

5 Claims, 25 Drawing Sheets

RETAINER BASE FOR DISPLAY ARTICLE

CROSS-REFERENCE TO RELATED APPLICATIONS

This application claims the benefit of priority of the U.S. Utility Provisional Patent Application No. 61/308,878, with a filing date of Feb. 26, 2010, the entire disclosure of which is expressly incorporated by reference in its entirety herein.

BACKGROUND OF THE INVENTION

Field of the Invention

The present invention is related to proper display of articles and, more particularly, to proper display of articles within a merchandising or security display box.

Description of Related Art

Merchandising or security display boxes are transparent security boxes (generally made of transparent glass or plastic) that are used to store articles, allowing a safe and visible display of the article from within the merchandising or security display box while preventing the articles from unauthorized removal from a store. An article is simply placed inside a merchandising or security display box and locked, and the locked merchandising or security display box and the article therein (which is visible) are displayed on a store shelf to be viewed by patrons of a store. The merchandising or security display boxes with the article therein may be picked-up by customers and handled to view the articles, but without accessing the actual article.

Regrettably, no provisions are made for preventing the movement of the article itself within the merchandising or security display box when the merchandising or security display box is moved around. That is, there are no provisions made for retaining or holding a position and proper display orientation of an article within a merchandising or security display box when the merchandising or security display box is moved or rough handled. The free movement of the article within a merchandising or security display box is especially an important problem if the article that is placed inside the merchandising or security display box is fragile and can easily break if it moves within the box and is hit against the walls thereof.

Accordingly, a need exists for a device that would enable safe, secure display of an article within a merchandising or security display box, and that would substantially prevent a movement of the article within the merchandising or security display box for maintaining proper position and display orientation of the article within the merchandising or security display box even if the merchandising or security display box is moved.

BRIEF SUMMARY OF THE INVENTION

An exemplary optional aspect of the present invention provides a device, comprising:

a base; and a retainer;

with the retainer holding and maintaining an article in a substantially fixed positioned on the base.

Another exemplary optional aspect of the present invention provides a device, wherein:

the retainer is adjustable to accommodate different sized articles.

Still another exemplary optional aspect of the present invention provides a device, wherein:

the retainer is comprised of a fixed support that holds and maintains the article in a substantially fixed positioned and proper orientation on the base within the container.

Yet another exemplary optional aspect of the present invention provides a device, wherein:

the retainer is comprised of a first support that urges the article against a second support that faces the first support for holding and maintaining the article in a substantially fixed positioned and proper orientation on the base within the container.

A further exemplary optional aspect of the present invention provides a device as, wherein:

the retainer is comprised of a plurality of supports, with a support of the plurality of supports positioned adjacent a next support of the plurality of supports, and oriented to form a set of spatially apart supports that face a common center, within which the article is positioned.

Still a further exemplary optional aspect of the present invention provides a device, wherein:

the base includes a housing for an adjuster mechanism that enables the retainer to adjust position and urge against the article;

the base is comprised cap that includes channel guides that enable an extended portions of the retainers to move with the channel guides.

Another exemplary optional aspect of the present invention provides a device, wherein:

the adjuster mechanism is comprised of:

a resilient module coupled with the retainer that urges the retainer against the article to frictionally hold and maintain the article in position and proper orientation within the container; and retainer guides that guide the retainer to an adjusted position to accommodate the article.

Still another exemplary optional aspect of the present invention provides a device, wherein:

the resilient module is comprised of:

a biasing guide that is coupled with the retainer, with the biasing guide housing a biasing mechanism;

the biasing guide is cooperatively associated with a synchronization mechanism that substantially synchronizes a movement of one biasing guide in relation with another biasing guide to synchronize a movement of a plurality of retainers.

Yet another exemplary optional aspect of the present invention provides a device, wherein:

the biasing guide is comprised of a set of indentations (notch, groove, serrations) formed along a longitudinal axis of the biasing guide that extend along an entire length of a first side;

the biasing guide further includes an elongated cavity oriented parallel the longitudinal axis, forming a section of a second side, and including an interlock protrusion extended from the elongated cavity for coupling a first distal end of the biasing mechanism, while a second distal end of the biasing mechanism is coupled with the cap of the housing.

A further exemplary optional aspect of the present invention provides a device as, wherein:

the synchronization mechanism is a pinion wheel with a set of teeth that are inserted along the indentations of a biasing guide cooperatively associated with the pinion wheel to synchronize the movement of the biasing guides, thereby the movement of the retainers.

An exemplary optional aspect of the present invention provides a method for retaining a free moving, smaller article within a larger security display box at a properly fixed position and orientation, comprising:

providing a device with a base that snug fits within a bottom of the security display box; and providing adjustable retainers that hold and maintain the article on the base at a desired, substantially fixed position and orientation.

Such stated advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character(s) present corresponding part(s) throughout:

FIGS. 6A to 6H are exemplary illustrations of an adjuster mechanism of the device of the FIGS. 1A to 5C in accordance with the present invention.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

Throughout the disclosure, references to the term "box" are meant to be illustrative and for convenience of example only, and should not be limiting. The term "box" or "merchandising or security display box" should be construed as a mere "container," or an "enclosure" that can hold an article, and which can take any shape or configuration. Therefore, the term "box" used throughout the disclosure can be interpreted as a rectangular box container, a cube configured container, a cylindrically configured container, or some other odd shaped container or even a container that is configured to represent a mascot or a logo of a corporation that can hold an article therein.

Figure 1A:
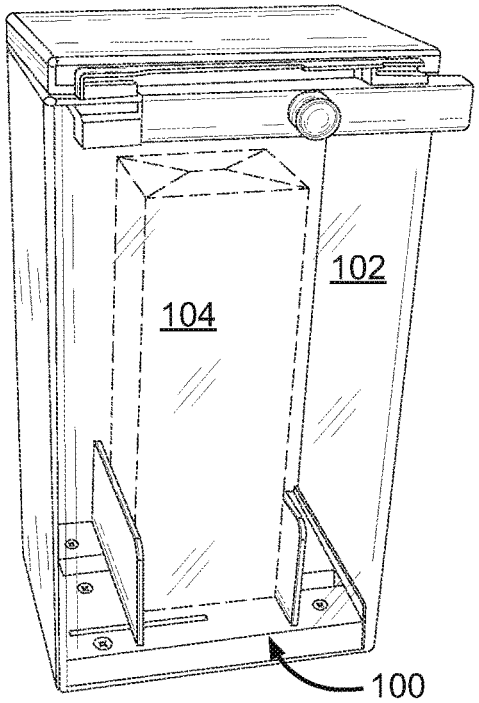
FIGS. 1A and 1B are exemplary illustrations of a device in accordance with the present invention, including an illustration of an exemplary merchandising or security display box.
Figure 1B:
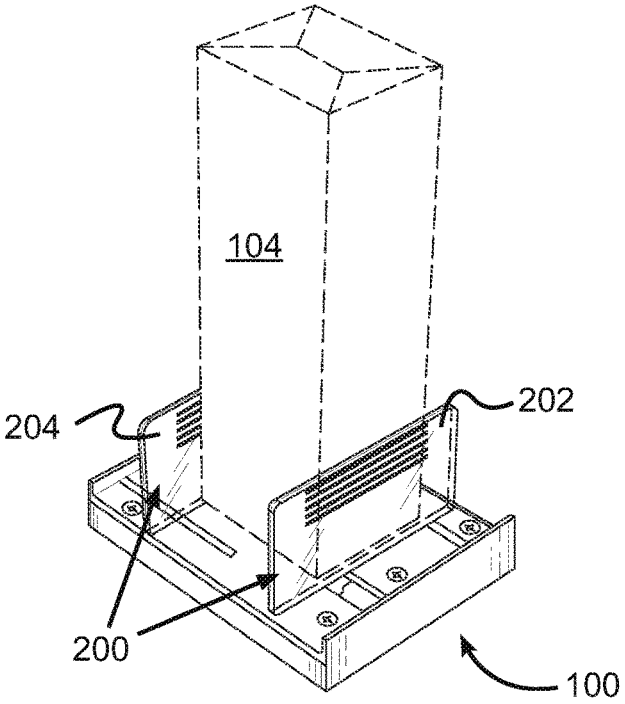
Figure 2A:
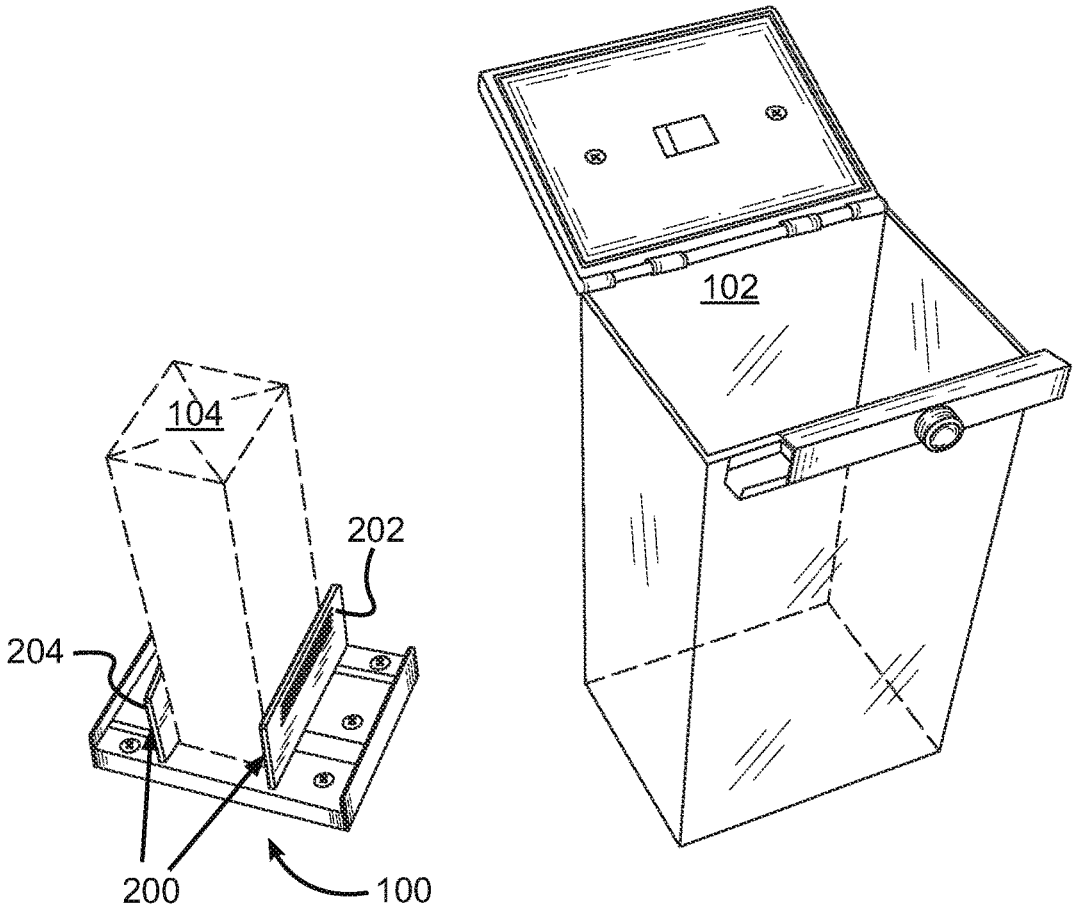
FIGS. 2A to 2D are exemplary illustrations that progressively show the placement of an article onto the device of FIGS. 1A and 1B of the present invention, with the device inserted or placed within the merchandising or security display box.
Figure 2B:
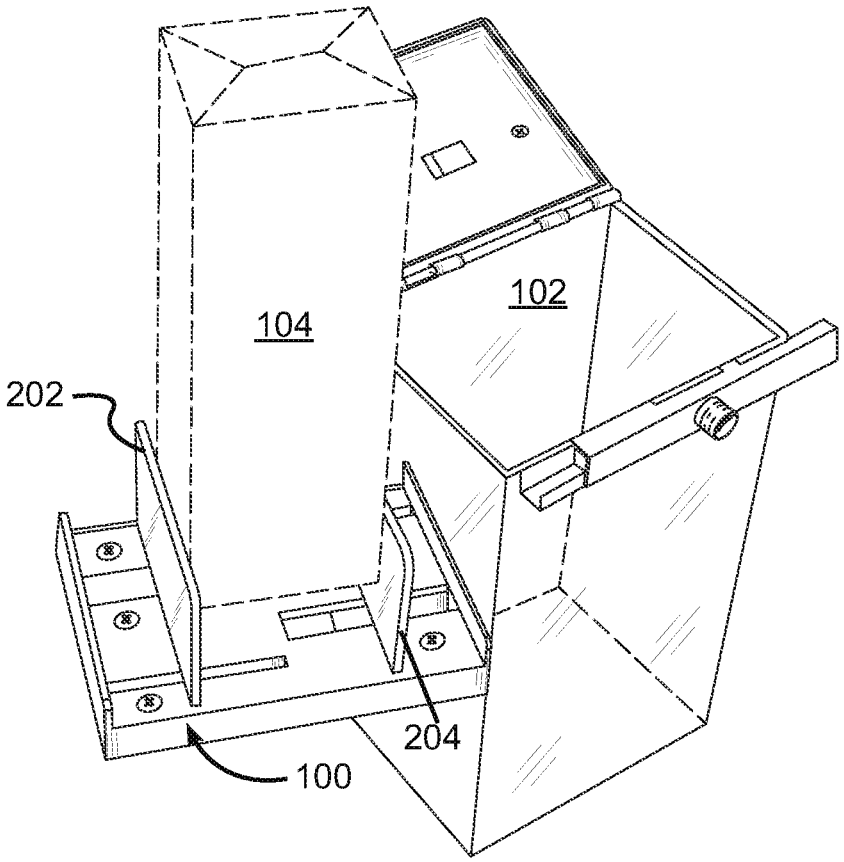
Figure 2C:
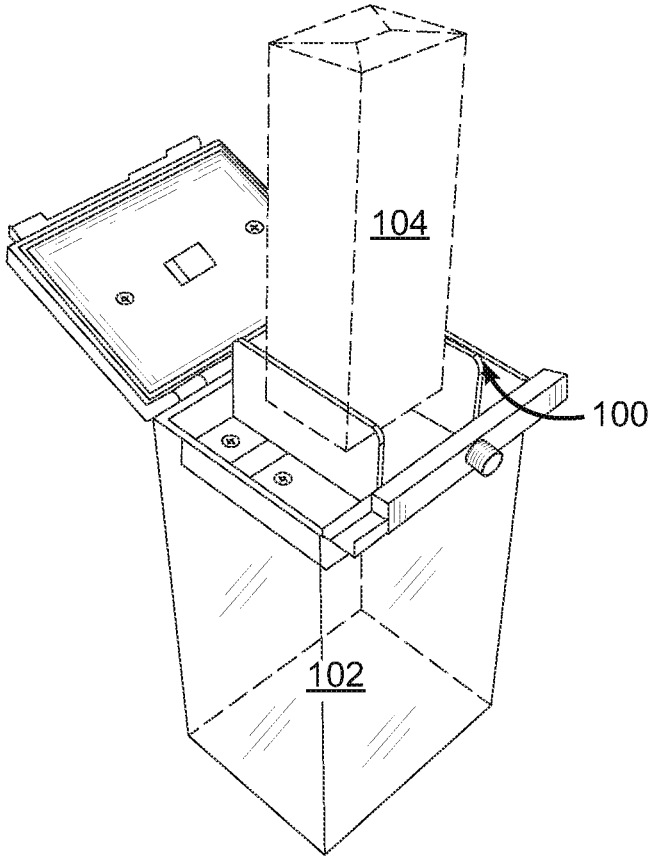
Figure 2D:
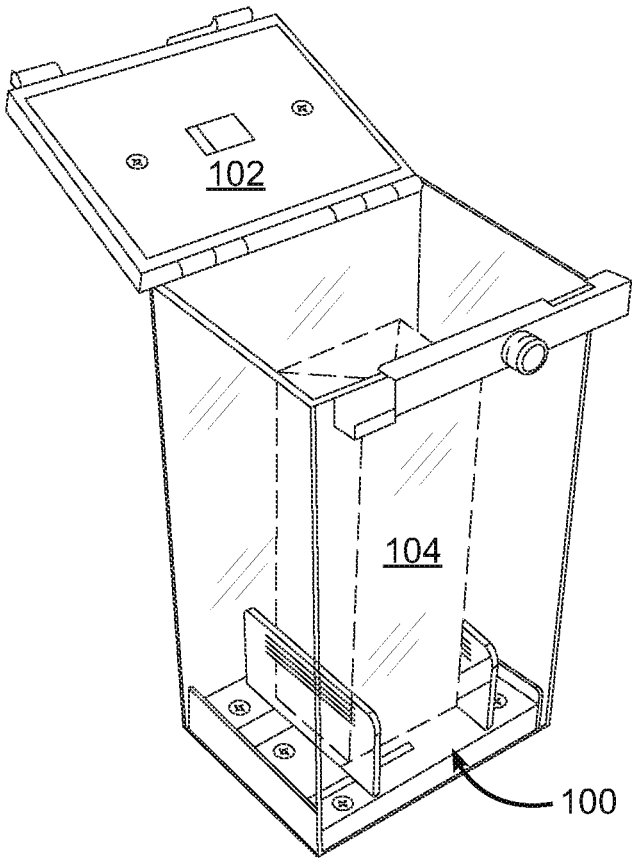

FIGS. 1A and 1B are exemplary illustrations of a device 100 in accordance with the present invention that enables a safe, secure display of an article 104 within a merchandising or security display box 102, preventing a substantial lateral and vertical movement of the article 104 within a merchandising or security display box 102 for maintain proper position and display orientation of the article 104 inside the merchandising or security display box 102 even if the merchandising or security display box 102 is moved. FIG. 1B is exemplary illustrations of the device 100 shown in FIG. 1A with the article 104 placed and held by a retainer 200 on device 100, in-between supports 202 and 204 of the retainer 200 in accordance with the present invention.

FIGS. 2A to 2D are exemplary illustrations that progressively show the placement of the article 104 onto the device 100 of the present invention, with the device 100 inserted or placed within the merchandising or security display box 102 and locked. As illustrated in FIGS. 2A to 2D, the device 100 prevents the lateral movement of the article 104 by the retainer 200 that includes the set of supports 202 and 204 (described in further detail below) that urge against the article 104. Additionally, the grip or hold of the retainer 200 against the article 104 is sufficiently strong to prevent the vertical movement of the article 104, even when held in mid-air by a user as exemplarily shown in FIGS. 2B and 2C. Accordingly, when placed inside the merchandising or security display box 102, the device 100 of the present invention will continuously maintain the proper display orientation of the article 104 within the merchandising or security display box 102.

Figure 3A:
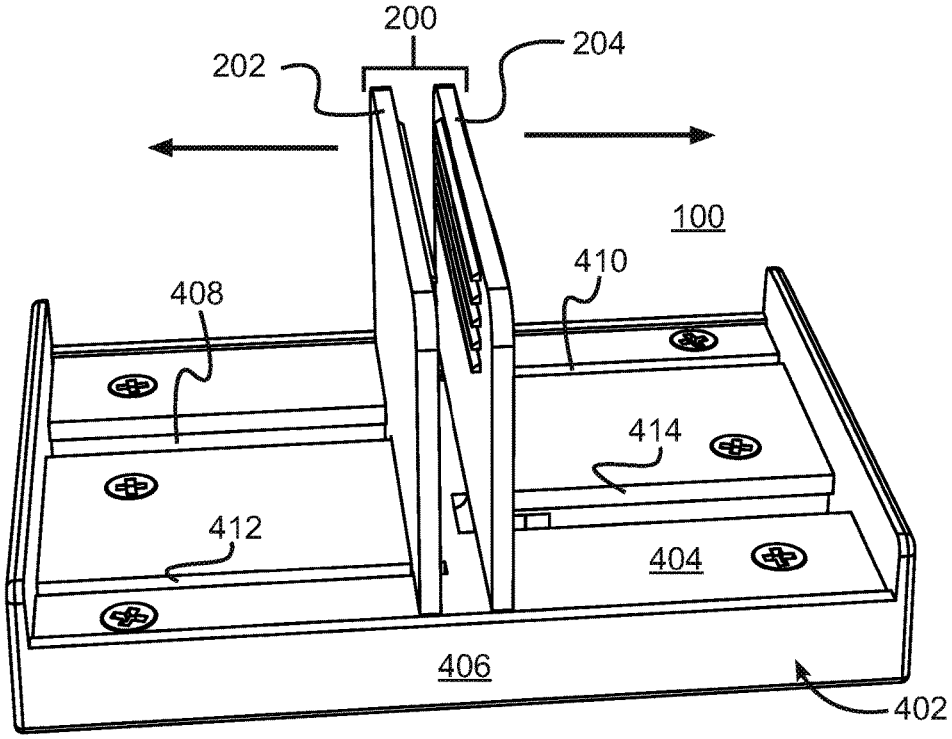
FIGS. 3A to 3C are exemplary illustrations of the various view of the device of FIGS. 1A to 2D in accordance with the present invention, with a retainer of the device in an exemplary default position.
Figure 3B:
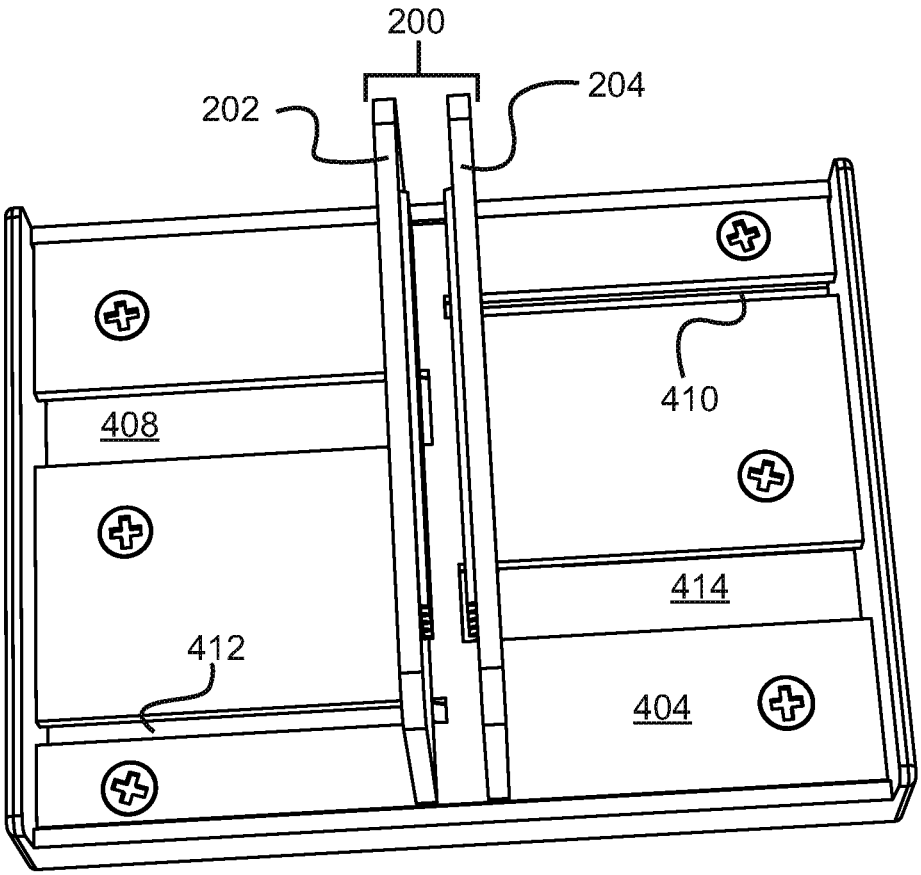
Figure 3C:
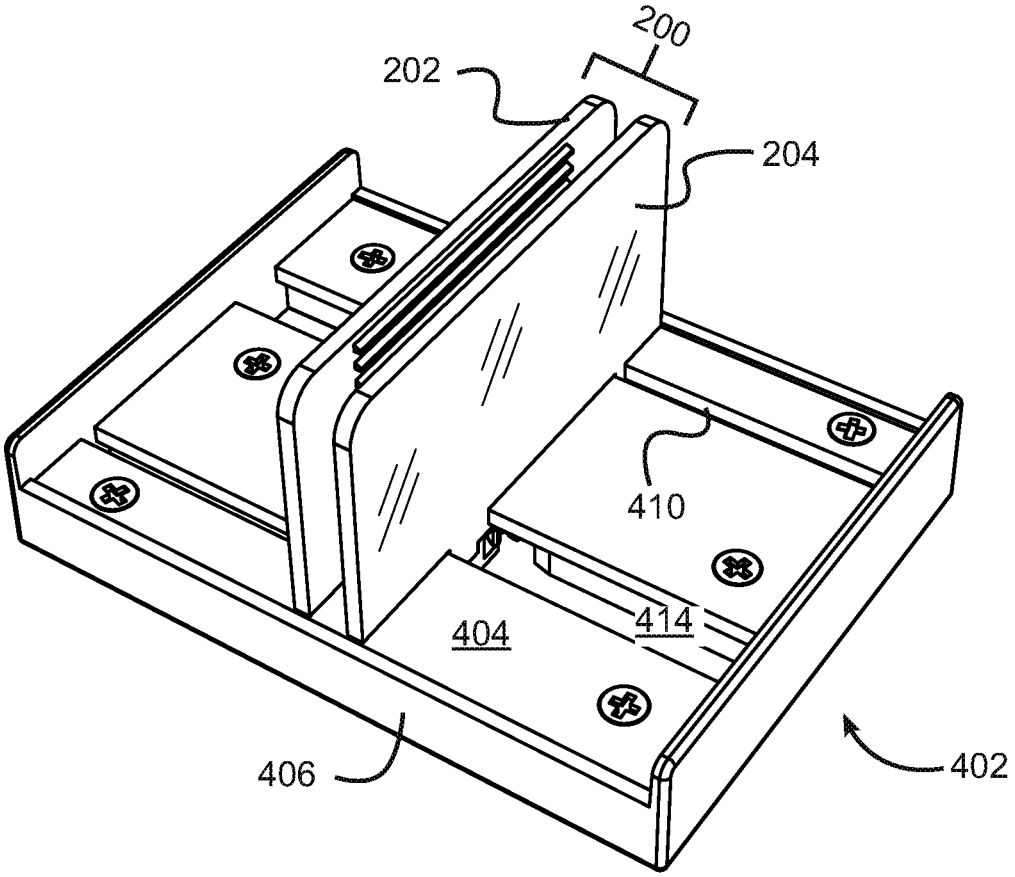

FIGS. 3A to 3C are exemplary illustrations of the various view of the device 100 in accordance with the present invention, with the retainer 200 in an exemplary default position. As illustrated, device 100 is comprised of a base 402 and retainer 200 (in the form of the set of supports 202 and 204) that are coupled with the base 402. The supports 202 and 204 of the retainer 200 need not have a substantially rectangular flat, vertical configuration with serrations (for added frictional support) at top as is exemplarily illustrated, but may have any shape and dimensions that can retain an article in between the supports 202 and 204 of the retainer 200. As a non-limiting example, the retainer 200 may be comprised of two semi-circular "C" shaped supports (not shown) that when brought together at the close proximity position as indicated in the FIGS. 3A to 3C, form a full cylinder instead of the illustrated substantially rectangular configuration. The formed cylinder can surround and hold, embrace or clinch a circumference of a cylindrically shaped article such as a bottle on the base 402, with the underlying mechanics that aid in the movements of the semi-circular supports identical to that, which is disclosed by the present invention. The illustrated top serrations (for added frictional support) may have any added material, e.g., rubber.

As further illustrated in FIGS. 3A to 3C, the base 402 is substantially configured commensurate to an inner perimeter of any container within which the device 100 and the article 104 are secured. In the exemplary illustrated embodiment, the base 402 is substantially rectangular. However, the base 402 may have any shape and dimension that can fit within a container. As a non-limiting example, the base 402 may have an elliptical, circular, or star configuration (not shown) that tightly and snuggly fits inside an exemplary rectangular merchandising or security display box. The base 402 may have any polygonal configuration that when inserted within a container, the base 402 is snug fit therein, and without affecting the underlying mechanics that aid in the movements of the supports 202 and 204 of the retainer 200.

As further shown, in the illustrated non-limiting embodiment, the retainer 200 is comprised of a first support 202 that urges the article 104 against a second support 204 that faces the first support 202 for holding and maintaining the article 104 in a substantially fixed positioned and proper orientation on the base 402. It should be noted that the first and second support 202 and 204 can be either fixed, movable (i.e., adjustable), or a combination of both where one is movable and the other is fixed. In such instances, the default position of the retainer 200 need not be as illustrated in the FIGS. 3A to 3C. Although the retainer 200 is illustrated to include only a respective first and a second support 202 and 204, the retainer 200 may include a plurality of supports, with a support of the plurality of supports positioned adjacent a next support of the plurality of supports, and oriented to form a set of spatially apart supports that face a common center. That is, the supports enclose a common area 506 with a center that is equally distant from a surface of each support that faces the area 506, with an article 104 retained within that common area 506. A non-limiting example of such arrangement that may include any number of supports that may be of any shaped that are aligned in any configuration (e.g., arced set of spaced apart walls) with a common center, within which an article is positioned. Another example may include three supports of any shape that are positioned to form the vertices of a triangle or some other polygon, all facing a central area common to all the supports. The supports may be movable, fixed, or a combination of movable (adjustable) supports and fixed supports, with the underlying mechanics for each support that aid in the movements of the supports of the retainer 200 similar to that of the present invention.

Figure 4A:
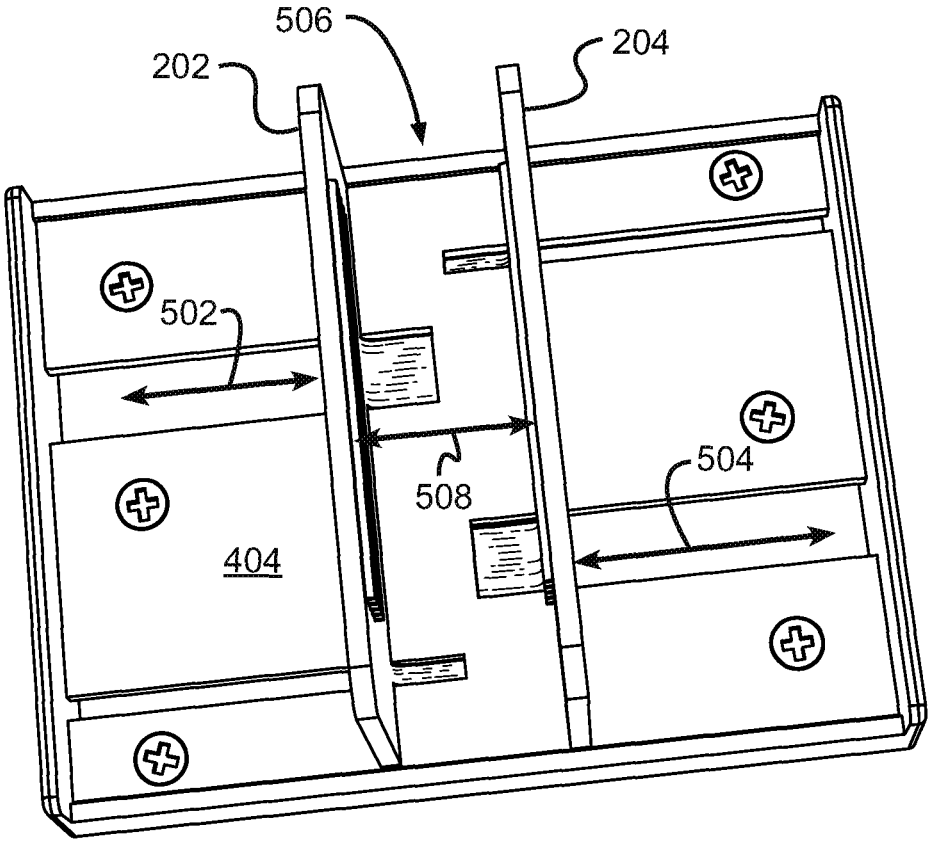
FIGS. 4A to 4F are exemplary illustrations of the device of FIGS. 1A to 3C, with the supports of the retainer of the device progressively adjusted and moved to different positions in accordance with the present invention.
Figure 4B:
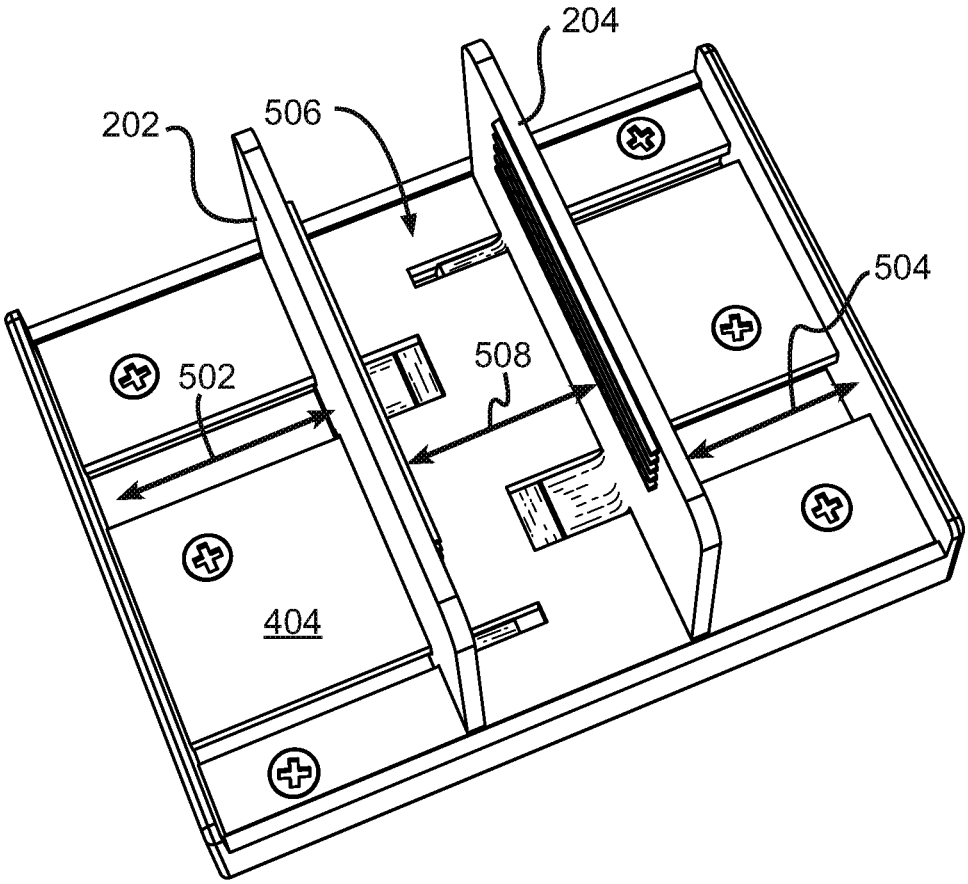
Figure 4C:
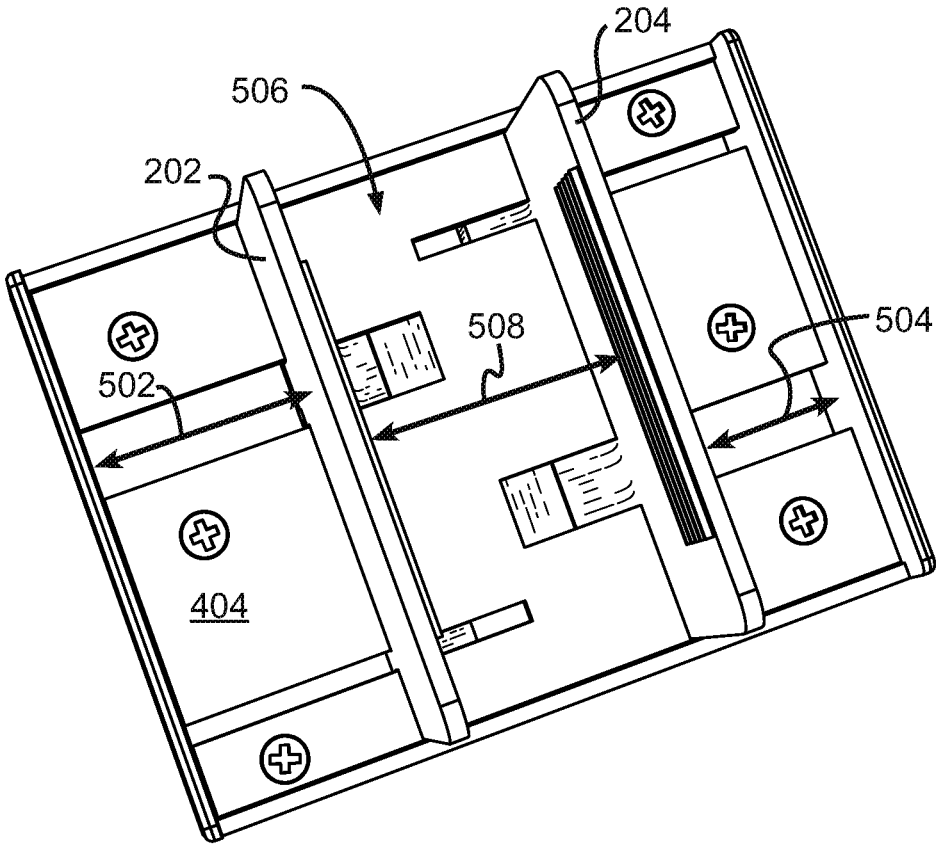
Figure 4D:
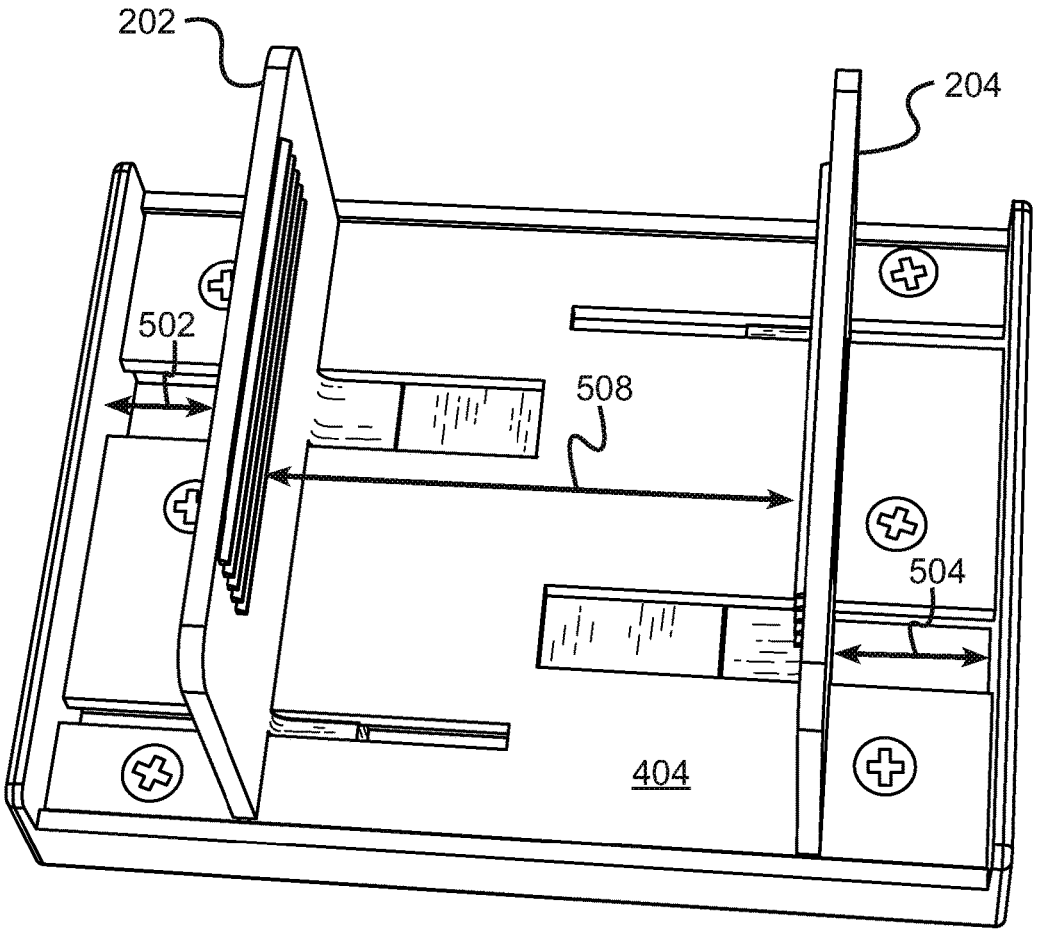
Figure 4E:
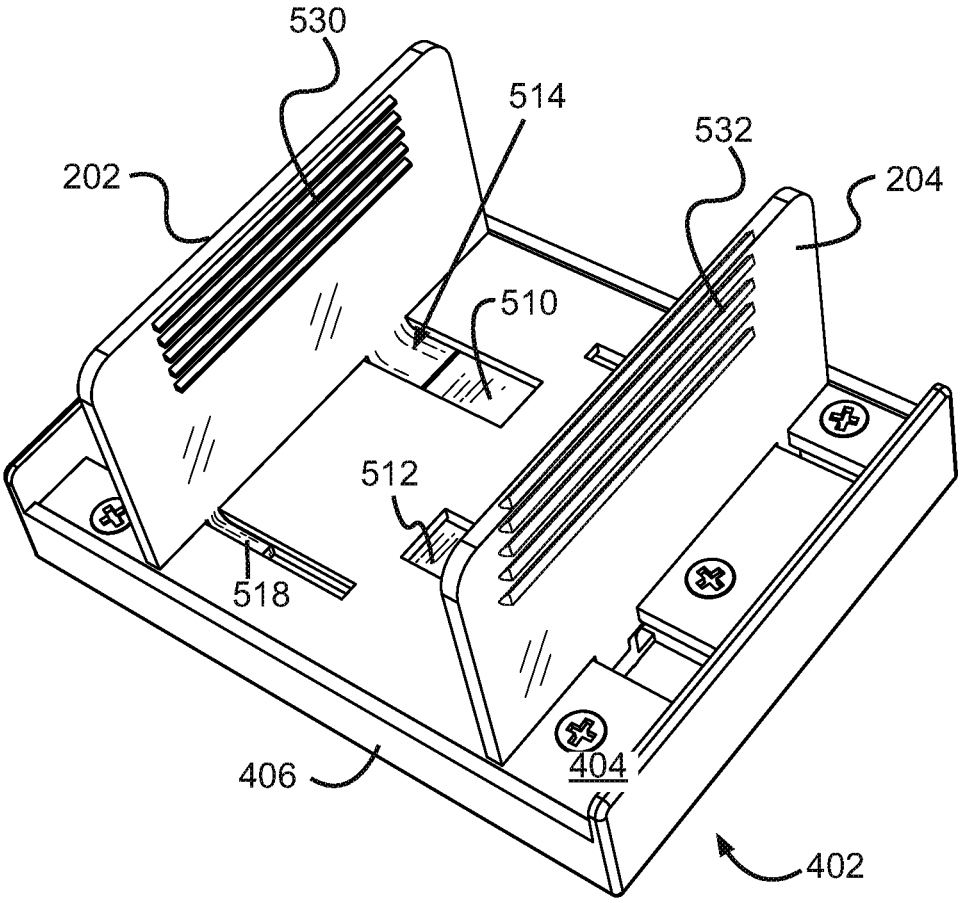
Figure 4F:
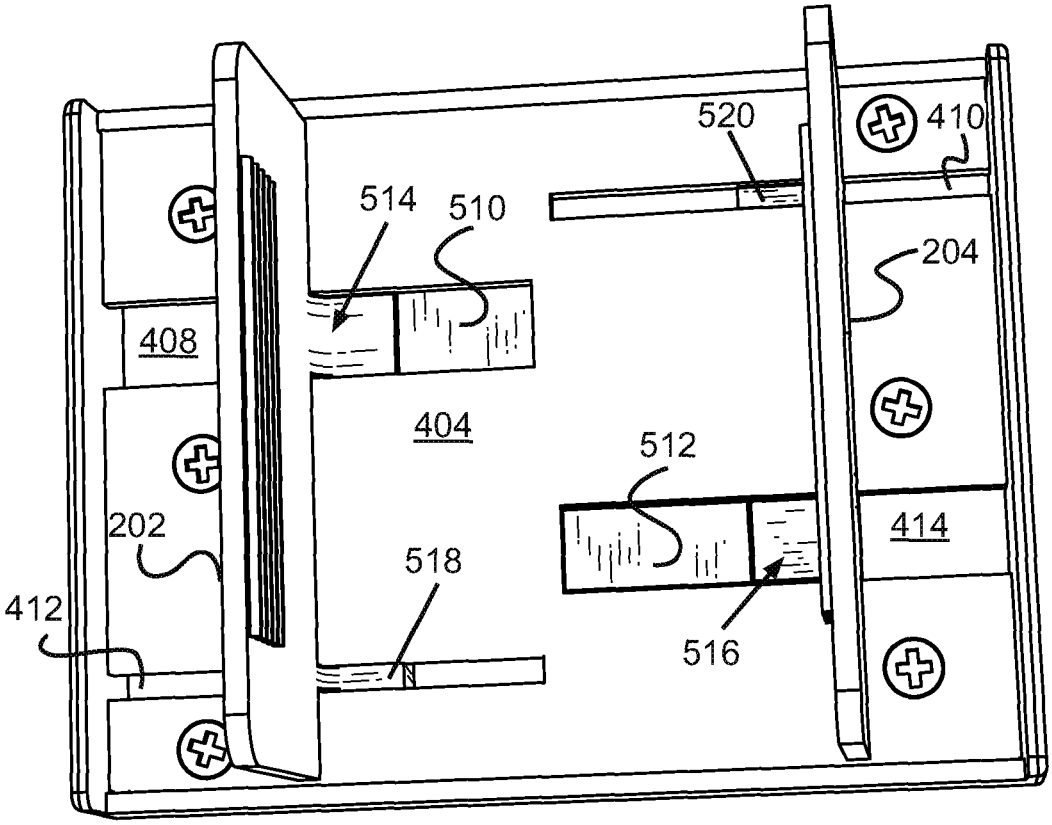

FIGS. 4A to 4F are exemplary illustrations of the device 100, with the supports 202 and 204 of the retainer 200 progressively adjusted and moved to different positions to increase the span 508 in-between the supports 202 and 204, which can accommodate different sized articles within the adjustable central area 506. As best illustrated in FIGS. 4E and 4F, the base 402 is comprised of a base housing 406 and a base cap 404 that is fastened to the base hosing 406. The base cap 404 includes a set of guide channels 408, 410, 412, and 414 that help guide the supports 202 and 204 of the retainer 200 along their reciprocating 502 and 504 on the base cap 404. This way, the supports 202 and 204 of the retainer 200 become adjustable to accommodate different sized articles 104. It should be noted that the guide channels 408, 410, 412, and 414 need not be straight, but may be spiral or semi-circular, with the reciprocating moving paths 502 and 504 moving along an exemplary semi-circle. The base 402 includes the housing 406 that houses an adjuster mechanism (detailed below) that enables the retainer 200 to adjust position and urge against the article 104. As best illustrated in FIG. 4F, the channel guides 408, 410, 412, and 414 also function to enable an extended portions 514, 520, 518, 516 of the retainer 200 to move within the respective channel guides 408, 410, 412, and 414, and be coupled with the underlying adjuster mechanism.

Figure 5A:
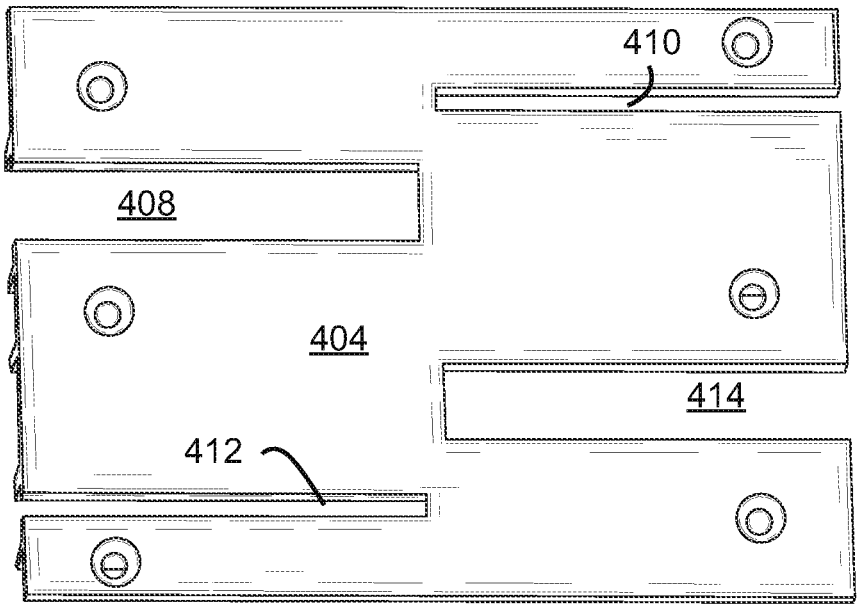
FIGS. 5A to 5C are exemplary illustrations of various views of the cap of the device illustrated in FIGS. 1A to 4F in accordance with the present invention.
Figure 5B:
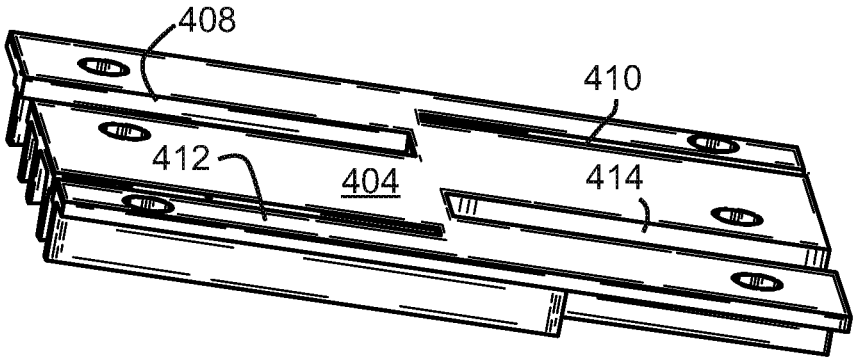
Figure 5C:
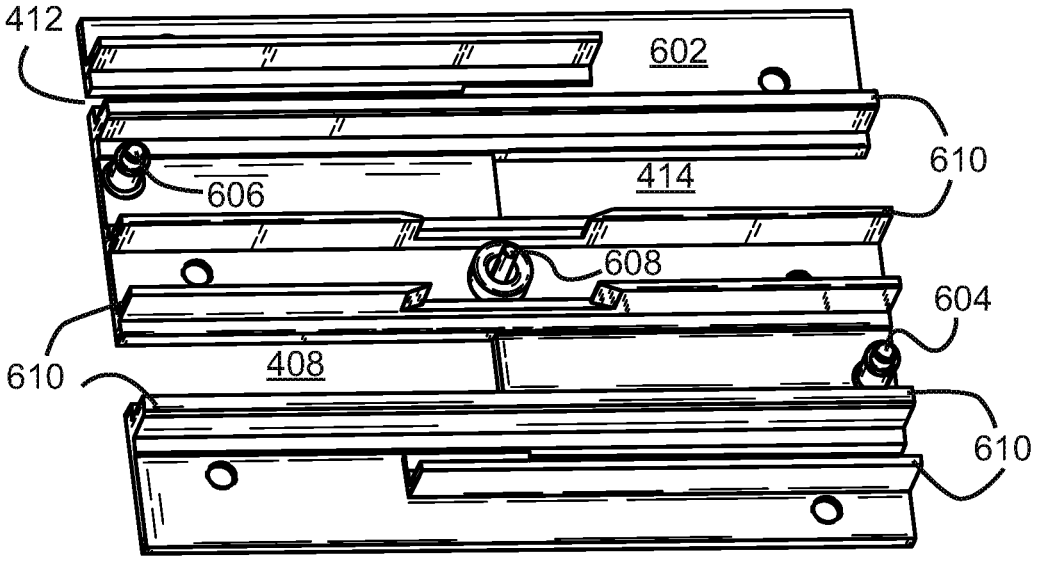

FIGS. 5A to 5C are exemplary illustrations of various views of the cap 404 in accordance with the present invention. As best illustrated in FIG. 5C, the cap 404 includes a bottom side 602 with a set of walls 610 that provide added support and structural integrity to the overall strength of the cap 404. The walls 610 also function as part of the structure of the guide channels 408, 410, 412, and 414 to reduce the lateral movement of the underlying adjuster mechanism with which the extended portions 514, 520, 518, 516 of the retainer 200 are coupled. The bottom side 602 of the cap 404 further includes first and second protrusions 604 and 606 that are used to couple with the underlying adjuster mechanism, and further includes a centrally located third protrusion 608 that is used for housing a synchronization mechanism of the adjuster mechanism. It should be noted that all the structure illustrated on the bottom side 602 of the cap 404 may easily be shifted to the bottom of the base housing 406, without affecting the underlying adjuster mechanism.

Figure 6A:
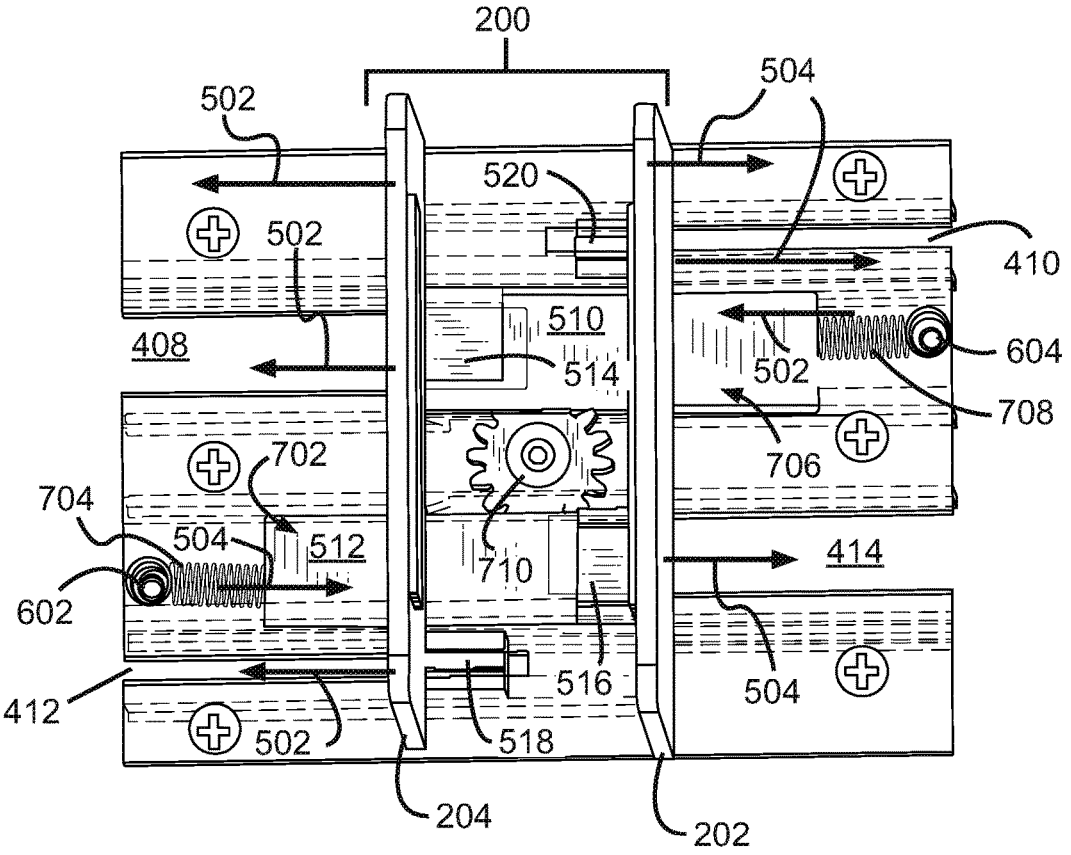
Figure 6B:
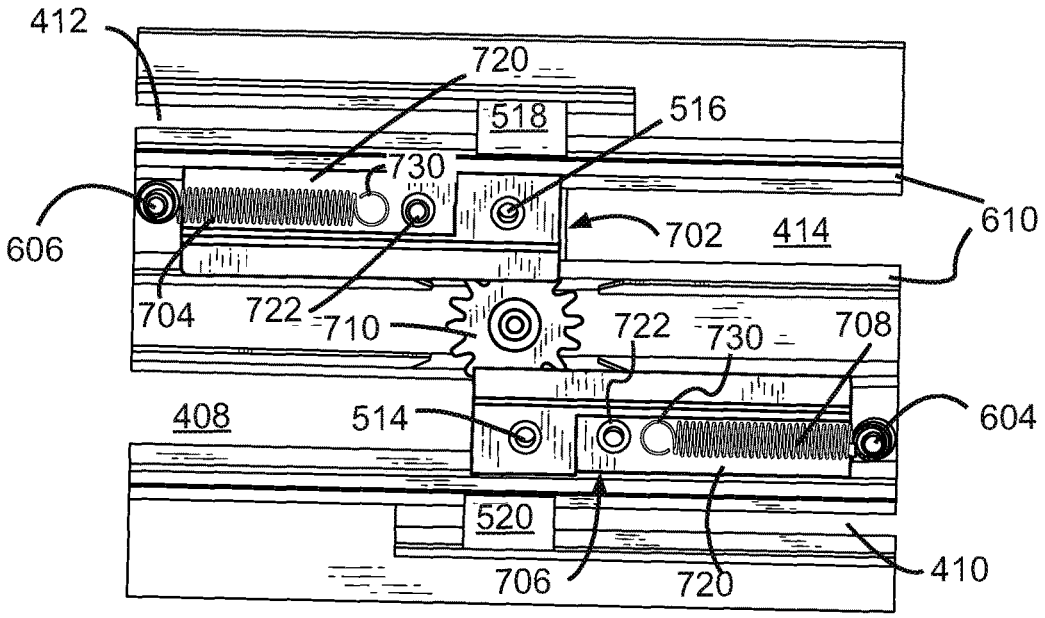
Figure 6C:
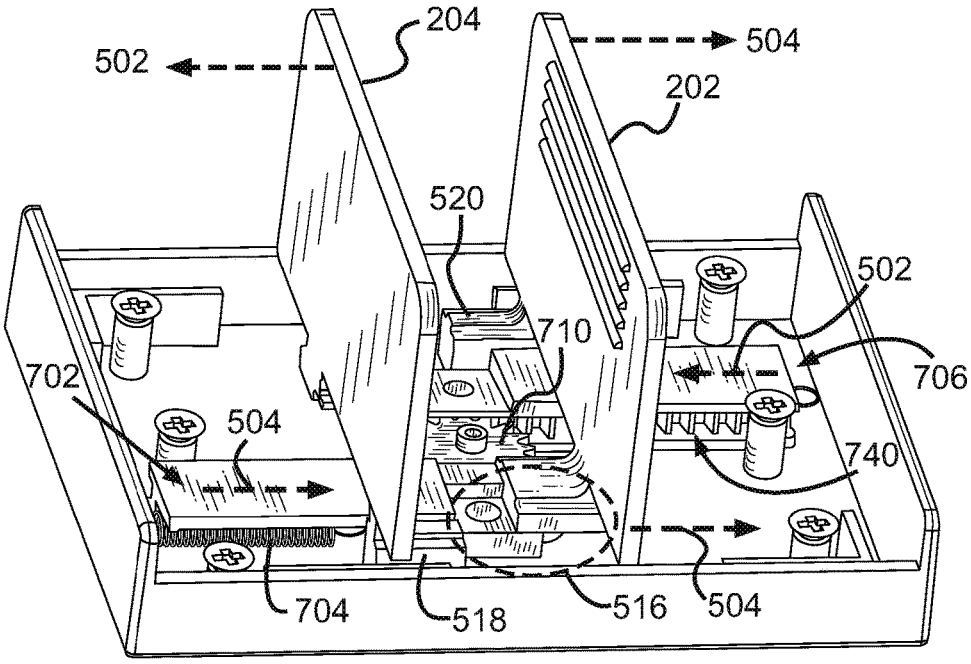
Figure 6D:
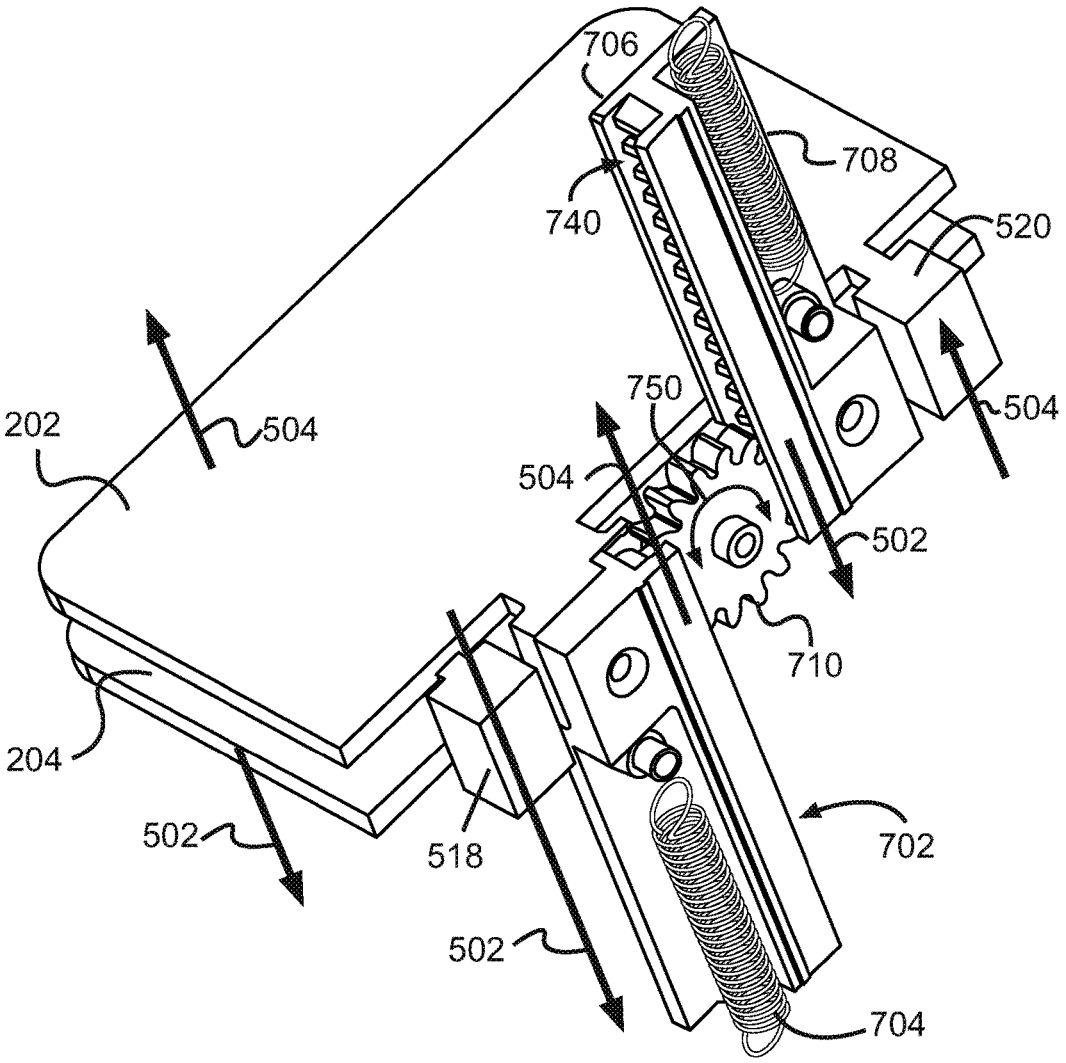
Figure 6E:
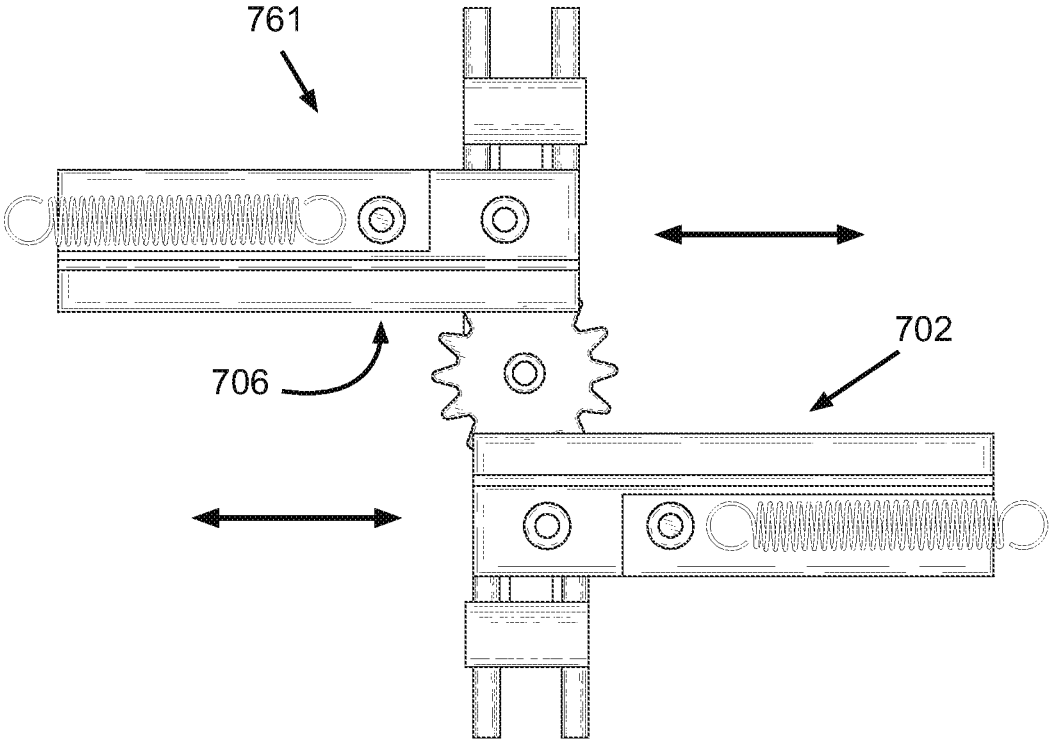
Figure 6E:
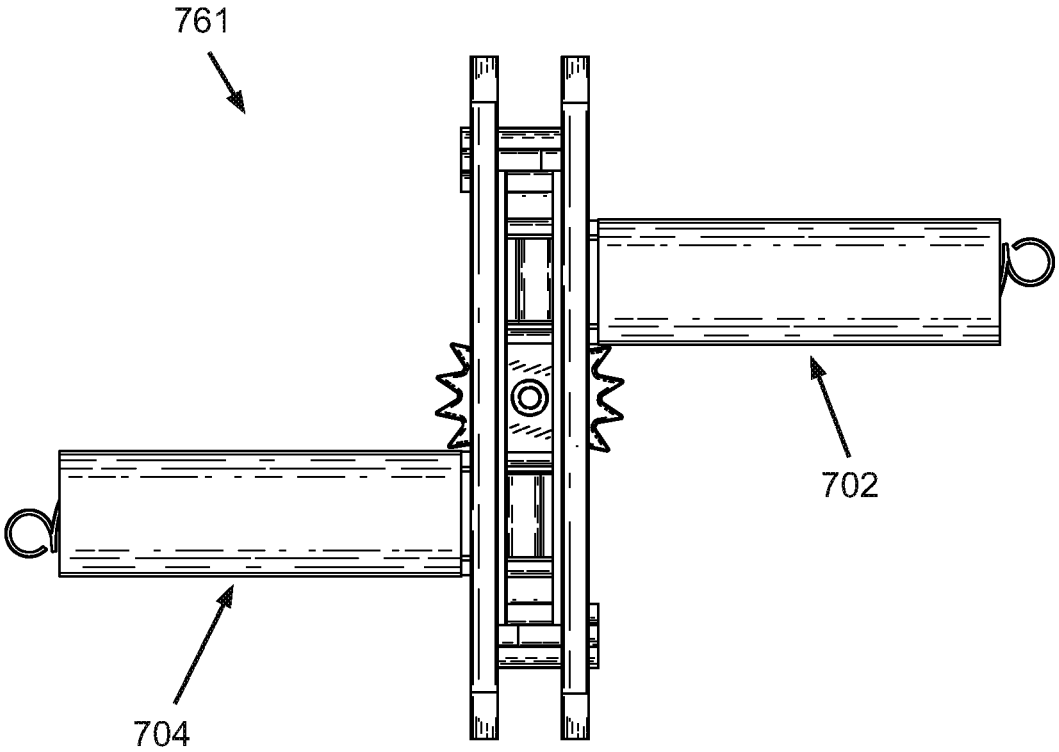
Figure 6G:
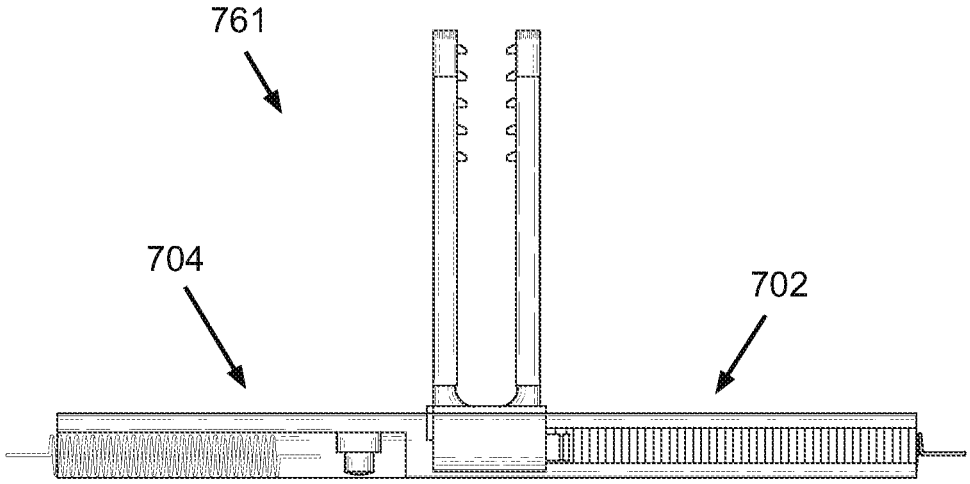
Figure 6H:
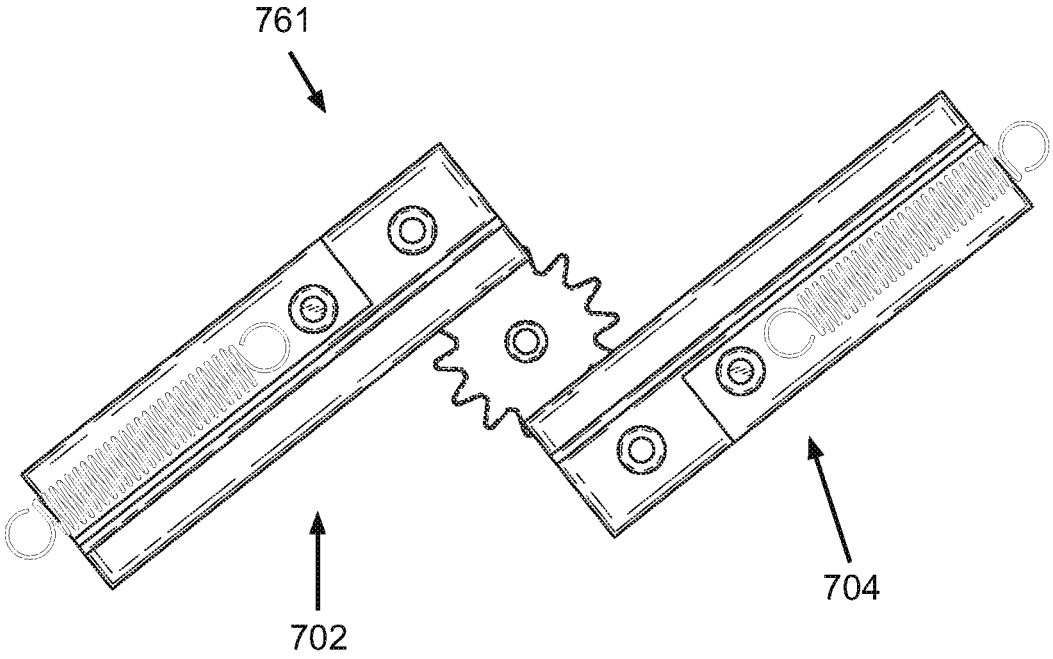

FIG. 6A is a top view of the device 100, with the cap 404 made semi-transparent to show the underlying adjuster mechanism, FIG. 6B is a bottom view of the device 100, with the base housing 406 made semi-transparent to show the adjuster mechanism, and FIG. 6C is the base housing 406 with the cap 404 removed. FIGS. 6D to 6H are exemplary illustration of the various views of the adjuster mechanism 761 coupled with the retainer 200 without the base 402. As illustrated in FIGS. 6A to 6H, the adjuster mechanism 761 is comprised of at least one resilient module 702 or 706 coupled with each support 202 and 204 that urges the retainer 200 against the article 104 to frictionally hold and maintain the article 104 in position and proper orientation within the container 102. Further included are a set of retainer guides 518 and 520 (described as the extension portion of the retainer 200) that guide the retainer 200 within channels 410 and 412 to an adjusted position to accommodate the article 104. A resilient module 702/706 is comprised of a biasing guide 510/512 that is coupled with the retainer 200, with the biasing guide 510/512 housing a biasing mechanism 704/708. The biasing guide 510/512 is cooperatively associated with a synchronization mechanism 710 that substantially synchronizes a movement of one resilient module 702 in relation with another resilient module 706 to synchronize a movement of a plurality of retainers 200.

As further illustrated, the biasing guide 510/512 is comprised of a set of indentations (notch, groove, serrations) 740 formed along a longitudinal axis of the biasing guide 510/512 that extend along an entire length of a first side. The biasing guide 510/512 further includes an elongated cavity 720 oriented parallel the longitudinal axis, forming a section of a second side, and including an interlock protrusion 722 extended from the elongated cavity 720 for coupling a first distal end 730 of the biasing mechanism 704/708, while a second distal end of the biasing mechanism 704/708 is coupled with the cap 404 of the housing. It should be noted that the illustrated exemplary rectangular configuration of the basing guide 510/512 is only for the convenience of example, and should not be limiting. The biasing guide 510/512 may comprise of a semi-circular or spiral configuration with indentations along an interior side of the semi-circle or spiral. The synchronization mechanism 710 is a pinion wheel with a set of teeth that are inserted along the indentations 740 of a biasing guide 510/512 cooperatively associated with the pinion wheel 710 to synchronize the movement of the biasing guides 510/512, thereby the movement of the retainer 200.

As illustrated in FIGS. 6A to 6H, as the supports 202 and 204 are pulled away from each other in the respective directions along the indicated reciprocating paths 504 and 502, the respective biasing mechanism 704 and 708 are stretched, urging the respective supports 202 and 204 in their respective opposite direction to grip and frictionally hold and secure an article in between within area 506. The pinion wheel is rotated along path 750, synchronizing the movement of the supports 202 and 204.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. For example, the retainer may comprise of a single fixed support that maintains the article against a wall of the container for holding and maintaining the article in a substantially fixed positioned and proper orientation on the base within the container. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A device, comprising:

a cap has a top side that includes guide channels;

a plurality of supports to frictionally hold and securely maintain an article;

the plurality of supports include extended portions that are coupled with an adjuster mechanism;

the extended portions of the plurality of supports extend through the guide channels on the top side of the cap to couple with the adjuster mechanism;

the adjuster mechanism positioned within a base;

the adjuster mechanism is comprised of;

biasing guides that are coupled with a retainer by the extended portions, with the biasing guides comprised of:

a set of indentations along a longitudinal axis of the biasing guides that extend along an entire length of a first side of the biasing guides;

an elongated cavity oriented parallel the longitudinal axis, which comprise a section of a second side of the biasing guides;

a biasing mechanism that has a first distal end coupled with an interlock protrusion of the biasing guide and a second distal end that is coupled with one of a first and a second protrusion of the cap;

the biasing guides are associated with one another by a synchronization mechanism to synchronize a movement of the biasing guides, which facilitate the synchronized movement of the plurality of supports;

the synchronization mechanism is comprised of a single pinion wheel coupled with a third protrusion of the cap;

the pinion wheel includes a set of teeth that are inserted along indentations of the biasing guides to synchronize a movement of the biasing guides.

2. The device as set forth in claim 1, wherein:

a support of the plurality of supports is positioned adjacent a next support of the plurality of supports, and oriented to form a set of spatially apart supports that face a common center.

3. The device as set forth in claim 1, wherein:

the retainer is adjustable to accommodate different sized articles.

4. The device as set forth in claim 1, wherein:

the retainer is comprised of a fixed support that holds and maintains the article in a substantially fixed positioned and proper orientation on the base.

5. The device as set forth in claim 1, wherein:

the retainer is comprised of a first support of the plurality of supports that urges the article against a second support of the plurality of supports that faces the first support for holding and maintaining the article in a substantially fixed positioned and proper orientation on the base.

* * * * *